US005077889A

United States Patent [19]

Matsuda et al.

[11] Patent Number: 5,077,889

[45] Date of Patent: Jan. 7, 1992

[54] PROCESS FOR FABRICATING A POSITIVE-TEMPERATURE-COEFFICIENT HEATING DEVICE

[75] Inventors: Yasuaki Matsuda, Sakado; Daisuke Takahata, Higashi-Matsuyama; Mitsuo Aoki, Soka; Hiroshi Takemura, Chofu, all of Japan

[73] Assignees: Ni-Cera; Mitsubishi Aluminum Kabushiki Kaisha, both of Japan

[21] Appl. No.: 627,813

[22] Filed: Dec. 14, 1990

Related U.S. Application Data

[62] Division of Ser. No. 432,496, Nov. 6, 1989.

[30] Foreign Application Priority Data

Nov. 7, 1988 [JP] Japan ..... 63-279484
Dec. 6, 1988 [JP] Japan ..... 63-308246
Jan. 19, 1989 [JP] Japan ..... 1-8727

[51] Int. Cl.[5] ..... H01C 7/02

[52] U.S. Cl. ..... 29/612; 228/180.1; 228/183

[58] Field of Search ..... 29/612; 228/183, 180.1, 228/218, 231; 338/22 R, 328, 329; 219/505, 540

[56] References Cited

U.S. PATENT DOCUMENTS 2,967,225 1/1961 Carrier, Jr. et al. ..... 219/540
4,414,052 11/1983 Habata et al. ..... 156/273.7
4,482,801 11/1984 Habata et al. ..... 219/540
4,626,295 12/1986 Sasaki et al. ..... 228/231
4,626,666 12/1986 Maeda et al. ..... 219/537
4,689,475 8/1987 Kleiner et al. ..... 219/553
4,937,435 6/1990 Goss et al. ..... 219/528
4,963,716 10/1990 Van Den Elst et al. ..... 219/202

FOREIGN PATENT DOCUMENTS 0243077 10/1987 European Pat. Off. .
2076270 11/1981 United Kingdom .
2090710 7/1982 United Kingdom .

OTHER PUBLICATIONS

Peck, C. E.; "Which Atmosphere for Heat-Treating and Brazing?" American Machinist; Jan. 13, 1949; pp. 90–94.

*Primary Examiner*—P. W. Echols
*Attorney, Agent, or Firm*—Banner, Birch, McKie & Beckett

[57] ABSTRACT

A process for fabricating a PTC thermistor device. A pair of opposing electrodes are formed on either major surface of a ceramic plate PTC thermistor element. Metallic plate heat radiation fins are secured to the opposing electrodes by brazing in a non-oxidizing environment. The PTC thermistor element is then heat treated in an oxidizing environment. Optionally, the opposing electrodes may include shield layers for preventing emission of gas from the PTC thermistor element during brazing.

5 Claims, 8 Drawing Sheets

PROCESS FOR FABRICATING A POSITIVE-TEMPERATURE-COEFFICIENT HEATING DEVICE

This application is a division of application Ser. No. 07/432,496, filed Nov. 6, 1989, pending.

TECHNICAL FIELD

The present invention relates to a positive-temperature-coefficient (PTC) heating device and a process for fabricating the same, and in particular to such a PTC heating device comprising heat radiating fins securely attached to a PTC thermistor heating element and a process for fabricating the same.

BACKGROUND OF THE INVENTION

As shown in FIG. 17, a conventional PTC heating device of this kind typically comprises a PTC thermistor element 1 in the form of a ceramic plate, a pair of opposite electrodes 3 formed on its opposite major surfaces to the thickness of approximately 10 micrometers by flame spraying, ion plating or printing, a pair of corrugated fin plates 5 placed on external major surfaces of the opposing electrodes 3, and a pair of fin covers 7 placed over the external sides of the corrugated fin plates 5. The corrugated fin plates 5 are securely attached to the opposing electrodes 3 by a bonding agent, and an electric contact is established between the corrugated fin plates 5 and the opposing electrodes 3.

Also known, is the structure in which a PTC thermistor element 1 having opposing electrodes 3 is clamped between a pair of metallic radiation fin plates 9 which are pressed toward each other by fastening screws 11 and nuts 13 as shown in FIG. 18.

When using these PTC thermistor heating devices, an AC voltage is applied across the opposing heat radiation fin plates 5 or 9 to heat up the PTC thermistor element 1.

However, since bonding agents generally have lower heat conduction effciencies than metallic materials, simply pressing heat radiation fin plates 9 against the opposing electrodes 3 either directly or via a bonding agent may not be sufficient to ensure a satisfactory heat conduction therebetween. Therefore, it has been desired to improve the efficiency of heat conduction between electrodes and heat radiation fin plates to the end of improving the thermal output of the PTC thermistor heating device.

Under this circumstance, the inventors focused their attention to the process of brazing two metallic parts, and completed the invention by overcoming problems related with brazing.

BRIEF SUMMARY OF THE INVENTION

In view of such problems of the prior art, a primary object of the present invention is to provide a PTC thermistor heating device which has a high thermal output and is simple in structure.

A second object of the present invention is to provide a PTC thermistor heating device which has a high mechanical strength and is durable.

A third object of the present invention is to provide a PTC thermistor heating device which is reliable.

A fourth object of the present invention is to provide a process for efficiently fabricating such a PTC thermistor heating device.

According to the present invention, these and other objects can be accomplished by providing a PTC thermistor device which includes a PTC thermistor element essentially made of a ceramic plate; a pair of opposing electrodes formed on either major surface of the PTC thermistor element to a thickness of 50 to 300 micrometers; and heat radiation fins made of metallic plates and having a plurality of peaks which are brazed to associated ones of the opposing electrodes. The process for fabricating such a PTC thermistor device includes forming a pair of opposing electrodes on either major surface of a PTC thermistor element consisting of a ceramic plate; securing heat radiation fins formed of metallic plates to the opposing electrodes in a non-oxidizing environment by brazing; and exposing the PTC thermistor element to an oxidizing environment at a temperature higher than 480 degrees C after securing the heat radiation fins thereto. Optionally, the opposing electrodes may include shield layers for preventing emission of gas from the PTC thermistor element during the brazing process.

According to the present invention, since the opposing electrodes are made thicker than those of conventional PTC thermistor devices and the heat radiation fin plates are directly attached to the opposing electrodes by brazing, the efficiency of heat conduction is much improved without giving rise to excessive thermal stress in the brazed parts. Further, since a substantial part of the opposing electrodes are exposed, the opposing electrodes themselves contribute to the improvement of heat radiation from the PTC thermistor device. By exposing the PTC thermistor element to an oxidizing environment after brazing the heat radiation fin plates to the PTC thermistor element, metallic components which have migrated from the brazing material into the voids of the PTC thermistor element are oxidized and transformed into electrically insulating materials, and the PTC property of the PTC thermistor element is thereby recovered. When emission of gas from the PTC thermistor element during brazing is prevented by providing shield layers, the integrity of the brazed part is improved, and, hence, the reliability of the PTC thermistor device is improved.

According to a preferred embodiment of the present invention, internal surfaces of the opposing electrodes facing the PTC thermistor element are provided with surface irregularities of an average surface roughness of 2 to 30 micrometers. Thereby, the attachment between the opposing electrodes and the PTC thermistor elements is much improved, and the PTC thermistor device becomes capable of withstanding repeated heating cycles.

According to another preferred embodiment of the present invention, edges of the PTC thermistor element are tapered towards their free ends to prevent short-circuiting of the opposing electrodes due to the brazing material bridging across the opposing electrodes.

BRIEF DESCRIPTION OF THE DRAWINGS

Now the present invention is described in the following with reference to the appended drawings, in which.

DESCRIPTION OF THE PREFERRED EMBODIMENTS

First Embodiment

Figure 1:
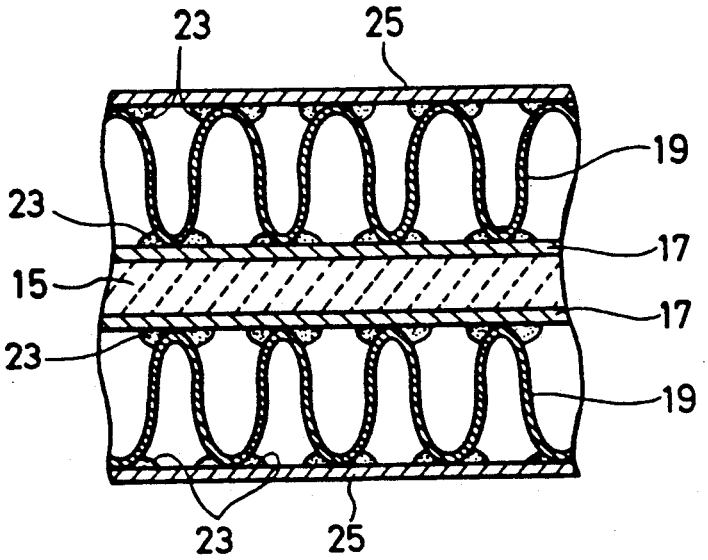
FIG. 1 is a fragmentary section view of a first embodiment of the PTC thermistor heating device of the present invention.
Figure 2:
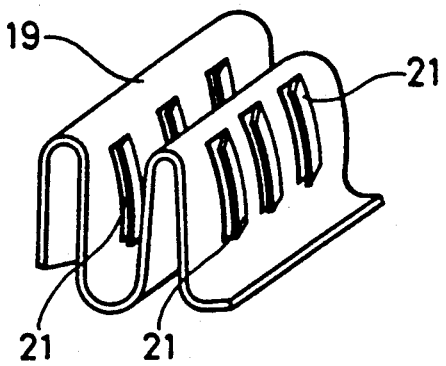
FIG. 2 is a fragmentary perspective view of one of the heat radiation fin plates shown in FIG. 1.

FIG. 1 shows a PTC thermistor heating device according to the present invention which comprises a planar PTC thermistor element 15 having the shape of an elongated rectangular plate made of ceramic material such as barium titanate added with a small amount of rare earth elements, and a pair of opposite electrodes 17 which are formed on the two major surfaces of the PTC thermistor element 15 by flame spraying or printing aluminum material to the thickness of approximately 100 micrometers. To the external surface of each of the opposite electrodes 17 is attached a corrugated fin plate 19 made of a strip of metallic plate such as an aluminum plate as shown in FIG. 2 by brazing the opposing peaks of the fins defined by the corrugated fin plates 19, and each of the corrugated fin plates 19 is provided with louver openings 21.

Figure 3:
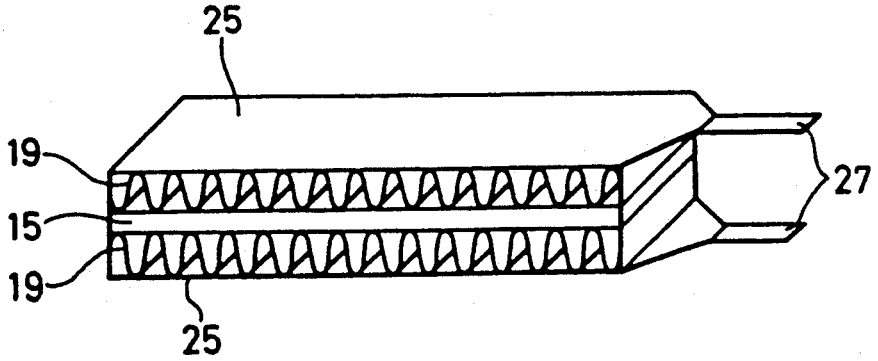
FIG. 3 is a schematic perspective view of the PTC thermistor heating device shown in FIG. 1.

To the external surface of each of the corrugated fin plates 19 is attached a fin cover 25 made of an aluminum plate by brazing the opposing peaks of the fins defined by the corrugated fin plate 19. As shown in FIG. 3, a terminal plate 27 is securely attached to an end portion of each of the fin covers 25. In FIG. 1, numeral 23 denotes the brazing material. It is understood here that "brazing" is used in a broad sense which includes soft soldering as a form of brazing.

According to this PTC thermistor heating device, since the opposing electrodes 17 are as thick as 100 micrometers, the efficiency of heat conduction from the PTC thermistor element 15 is high. Also, since the opposing electrodes 17 are directly brazed to the corrugated fin plates 19, a large amount of heat is transferred from the PTC thermistor element 15 to the corrugated fin plates 19. Further, since the opposing electrodes 17 are only partly in contact with the associated peaks of the fins defined by the corrugated fin plates 19, the remaining surface area of the opposing electrodes 19 also contribute to the increase in heat output by serving as a heat radiation surface.

Figure 4:
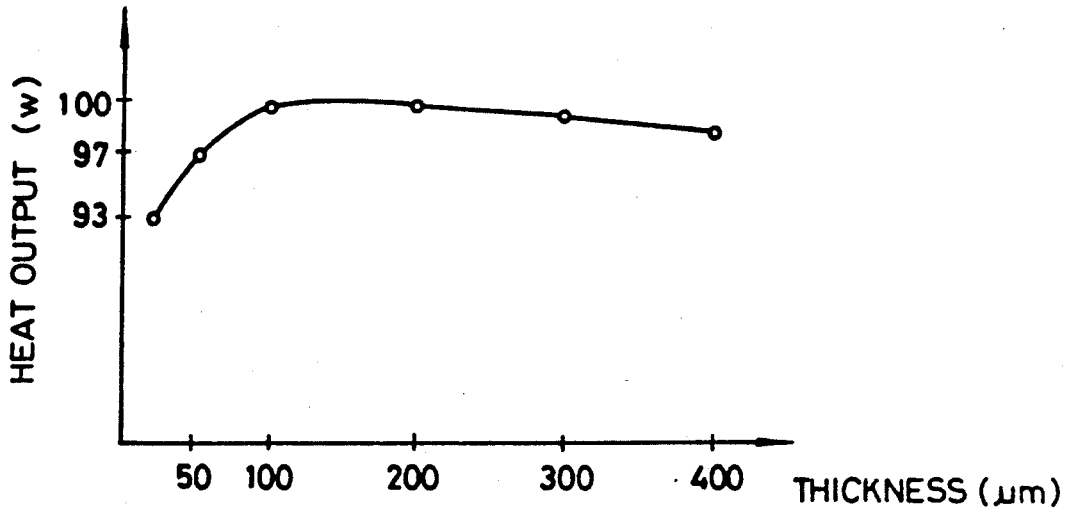
FIG. 4 is a graph showing the relationship between the thickness of the opposing electrodes and the thermal output according to the first embodiment of the present invention.

The inventors have conducted a series of experiments on PTC thermistor heating devices having the structure of the embodiment illustrated in FIG. 1. The corrugated fin plates 19 had the fin pitch of two to five millimeters, and the PTC thermistor element 15 measured 24 mm in length, 15 mm in width and 2.5 mm in thickness. The thickness of the opposing electrodes 17 was varied and the heat output was measured in each instance, and the relationship as shown in FIG. 4 was obtained. As can be seen from the graph of FIG. 4, in order to obtain a heat output of approximately 100 W, the opposing electrodes 17 are required to be at least 50 micrometers in thickness, but the thickness is not required to be greater than 300 micrometers.

It was found that, since only the peaks of the fins defined by the corrugated fin plates 19 are in contact with the opposing electrodes 17, even when there are differences in the coefficients of thermal expansion between the corrugated fin plates 19, the opposing electrodes 17 and the PTC thermistor element 15, the relative movement between these parts due to changes in their temperatures can be accommodated by the deformation of the corrugated fin plates 19 without creating any undue stress in the areas where the corrugated fin plates and the opposing electrodes are joined. Thus, the PTC thermistor heating device according to the present invention is capable of enduring severe temperature change cycles, and can therefore provide an extremely long service life.

The corrugated fin plates 19 may be selected, besides from aluminum, from such materials as copper, steel, their alloys, and steel plated with zinc, nickel, aluminum or tin which are easy to handle and have favorable mechanical strengths. The material for the opposing electrodes 17 may be selected from copper, zinc, nickel and their alloys. The brazing material may be selected from those which are compatible with the materials for the corrugated fin plates and the opposing electrodes.

According to the present embodiment which is schematically illustrated in perspective view in FIG. 3, the PTC thermistor element 15, the corrugated fin plates 19, the fin covers 25, and the terminal plates 27 including the parts where they are connected with the fin covers 25 are covered by electrically insulating and heat resistant resin material such as silicone or flon materials so as to reduce the possibility of causing an electric shock or short-circuiting when a body part or a foreign object has come into contact with the corrugated fins 19 or the fin covers 25.

Second Through Fourth Embodiments

Figure 5A:
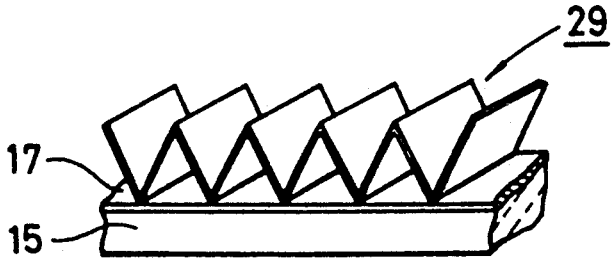
FIGS. 5A, 5B and 5C are fragmentary perspective views of second through fourth embodiments of the present invention.
Figure 5B:
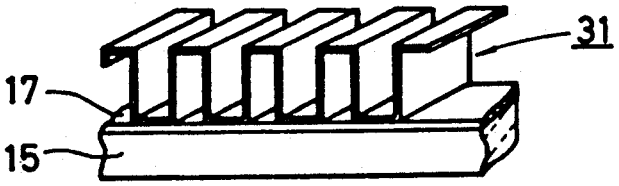

The corrugated fin plates 19 shown in FIG. 1 are only an example, and the present invention is in no way limited by this embodiment. For instance, it is possible to fold an aluminum plate so as to define a fin plate 29 defining relatively sharper folding lines as illustrated in FIG. 5A, and to braze the abutting sharp peaks or edges of the fin plate 29 to the opposing electrode 17 of the PTC thermistor element 15 (second embodiment). Alternatively, an aluminum plate may be folded by 90 degrees at regular interval or into a castellated shape to define a fin plate 31 and to braze the abutting flat peaks of the fin plates 31 to the opposing electrodes 17 as illustrated in FIG. 5B (third embodiment).

Figure 5C:
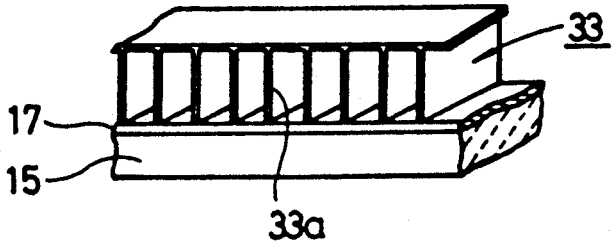

According to a fourth embodiment of the present invention, each of the fin plates 33 is provided with a plurality of fins 33*a* projecting perpendicularly therefrom, and the edges at the free ends of these fins 33*a* are abutted to and brazed to the external surface of the opposing electrode 17 as illustrated in FIG. 5C.

In short, according to the present invention, the free ends of the fins provided in or defined by the fin plates are abutted to the external surfaces of the opposing electrodes, and are brazed thereto. The fins may have various shapes as shown in FIGS. 1 and 5A through 5C, and their free ends may have accordingly different shapes such as rounded folding lines, sharp folding lines, flat surfaces, and simple edges.

Fifth through Eighth Embodiments

Figure 6A:
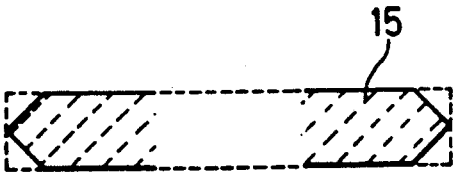
FIGS. 6A, 6B, 6C and 6D are sectional views of fifth through eight embodiments of the present invention.
Figure 6B:
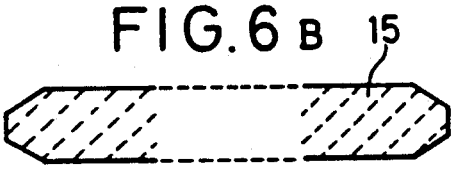
Figure 6C:
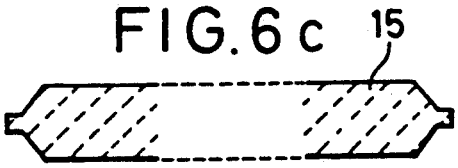
Figure 6D:
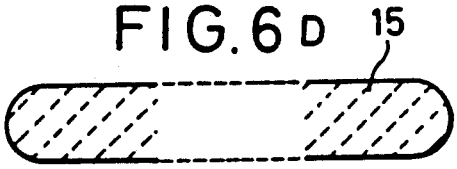

In order to obtain a high production efficiency, it is desirable to arrange a plurality of PTC thermistor elements each provided with a pair of opposing electrodes 17 one next to the other and to braze corrugated fin plates thereto. In such a case, a precaution must be taken so that brazing material 23 may not cling to the edges of the PTC thermistor elements 15 by a capillary action. If the brazing material 23 forms a bridge across a pair of associated opposing electrodes 17, a short-circuiting will occur. To positively prevent such an occurrence, according to the present invention, the side edges of the PTC thermistor elements 15 are chamfered so as to have triangular (fifth embodiment illustrated in FIG. 6A) and trapezoidal (sixth embodiment illustrated in FIG. 6B) cross sections. Alternatively, the edges may be provided with a central rib separating the two major surfaces of the PTC thermistor element (seventh embodiment illustrated in FIG. 6C), and the edges may be rounded (eighth embodiment illustrated in FIG. 6D).

Ninth Embodiment

Figure 7:
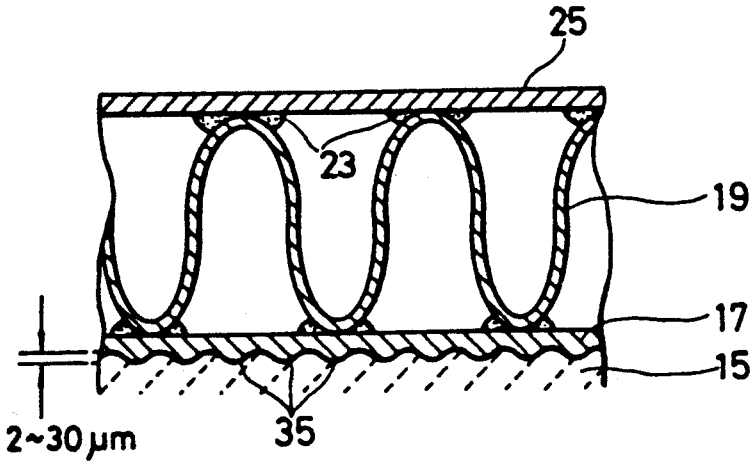
FIG. 7 is a fragmentary sectional view of a ninth embodiment of the present invention.

When the thickness of the opposing electrodes 17 is large, the opposing electrodes 17 may peal off from the PTC thermistor element 15 due to the difference in the thermal expansions of the two different parts after repeated heat cycles. However, such a possibility may be eliminated by the ninth embodiment illustrated in FIG. 7. Specifically, the major surfaces of the PTC thermistor element 15 are provided with surface irregularities 35 of a surface roughness of approximately 2 to 30 micrometers, and the opposing electrodes 17 are formed by flame spraying an aluminum material onto the major surfaces of the PTC thermistor element so as to fill the cavities defined by the surface irregularities. By thus forming the opposing electrodes 17 so as to achieve a close contact between them, the opposing electrodes 17 are positively prevented from peeling off from the PTC thermistor element 15 even when the thickness of the opposing electrodes 17 is increased. The close contact between the PTC thermistor element 15 and the opposing electrodes 17 over a large surface area also contributes to a favorable heat transfer from the PTC thermistor element 15 to the opposing electrodes 17.

Figure 8:
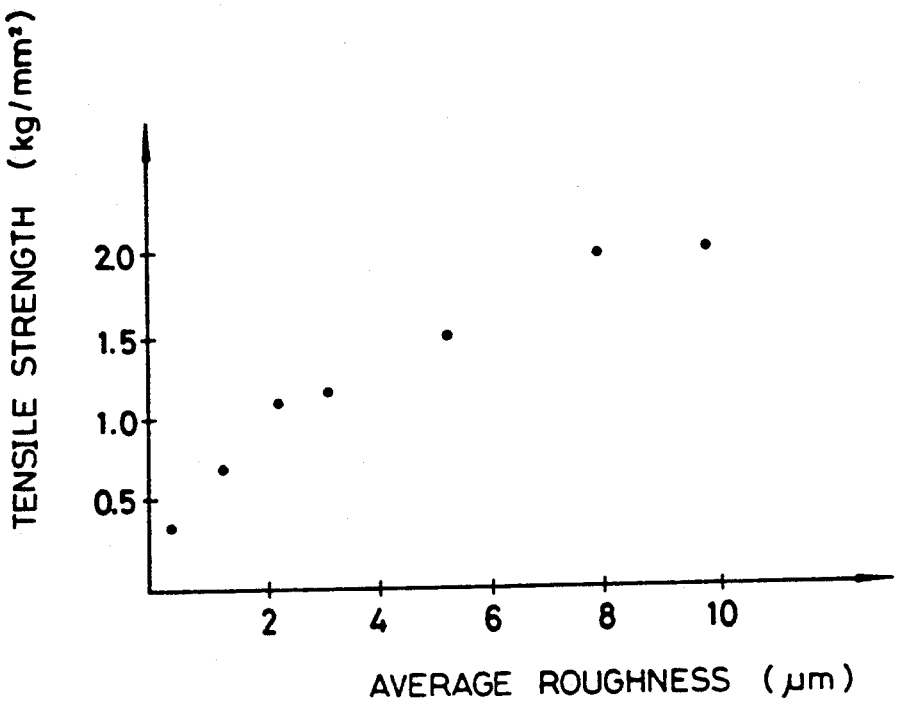
FIG. 8 is a graph showing the relationship between the average surface roughness and the tensile strength of the ninth embodiment.

The inventors have conducted various experiments by changing the average particle sizes of the material for the PTC thermistor elements 15 and the conditions for baking them, and changing the surface roughness of the PTC thermistor elements 15 by sand-blasting their surfaces, in order to find the influences of these factors upon the mechanical strength of the opposing electrodes which were formed by flame spraying aluminum material onto the surfaces thereof. According to these experiments, it was found that the surface irregularities are required to be of a surface roughness of more than 2 micrometers in order to achieve a desired tensile strength of 0.8 $kg/mm^2$ as shown in FIG. 8, but are required to be less than 30 micrometers in order to ensure the heat dissipating capability of the opposing electrodes.

Tenth Embodiment

Typically, brazing is performed in a high temperature environment of approximately 600 degrees C., and the opposing electrodes 17 may become porous due to gas which is emitted from the PTC thermistor element 15 during brazing, and this may impair the mechanical integrity of the brazed parts of the heat radiation fin plates 19.

Figure 9:
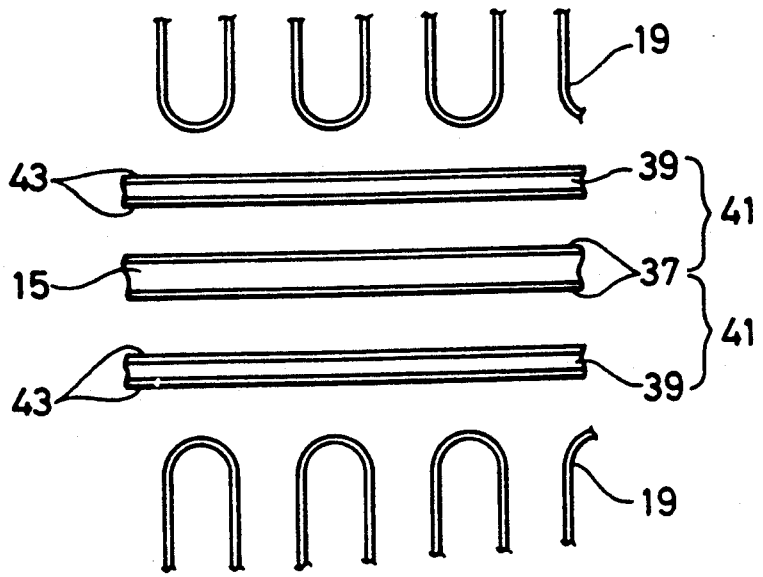
FIG. 9 is a schematic exploded front view of a tenth embodiment of the present invention.

This problem can be avoided by forming opposing electrodes having the thickness of 50 to 300 micrometers by depositing metallic films on the surfaces of the PTC thermistor element 15 by flame spraying and then overlaying and attaching thin shield plates 39, for instance, made of aluminum, thereon by brazing as illustrated in FIG. 9. The shield plates 39 shield the gas emission and ensure the mechanical integrity of the brazed part 43 between the opposing electrodes 41 (or the shield plates 39) and the heat radiation fin plates 19.

Eleventh Embodiment

Figure 10:
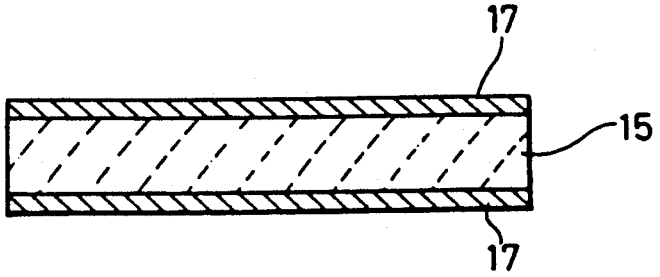
FIGS. 10, 11 and 12 are sectional views showing different stages of fabricating an eleventh embodiment of the PTC heating device of the present invention.
Figure 11:
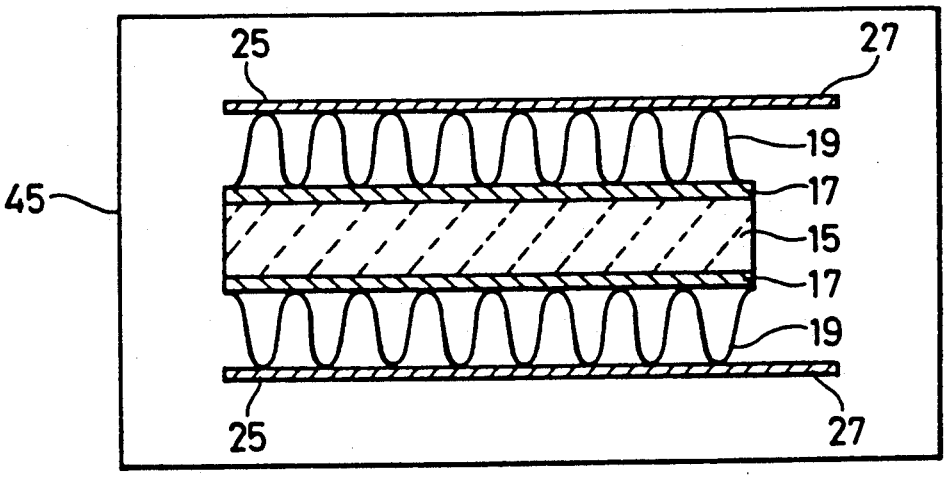
Figure 12:
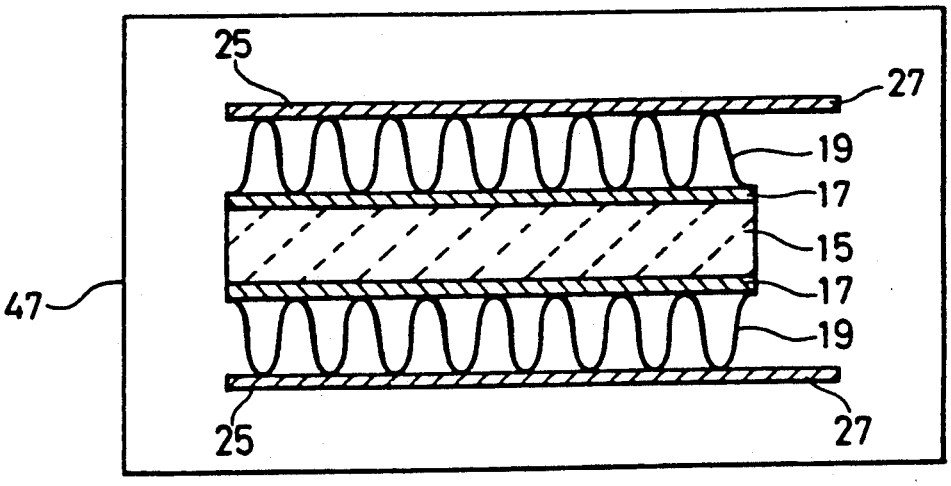

FIGS. 10 through 12 show various stages of fabricating the first embodiment of the PTC thermistor device according to the present invention in time sequence. First of all, the opposing electrodes 17 are formed to the thickness of 50 to 300 micrometers by flame spraying aluminum material onto the major surfaces of the PTC thermistor element 15 as shown in FIG. 10. Then, a pair of corrugated fin plates 19 each made of an aluminum plate and coated with a layer of brazing material on either surface thereof and a pair of fin covers 25 are placed on either surface of the PTC thermistor element 15 one over the other. This assembly is then placed in a vacuum chamber 45 as shown in FIG. 11. The brazing material may contain a metal for promoting brazing such as magnesium.

The vacuum chamber 45 is evacuated to the pressure level of approximately $10^{-5}$ Torr. The assembly is heated to a temperature, for instance 600 degrees, which is higher than the melting point of the brazing material, and is subsequently cooled to the room temperature so that each of the corrugated fin plates 19 may be integrally attached to both the associated fin cover 19 and the associated opposing electrode 17.

Thereafter, the assembly consisting of the PTC thermistor element 15, the corrugated fin plates 19 and the fin covers 25 which are joined integrally together is placed in an oxidation chamber 47 and is heated for about four hours at 480 degrees C. and under atmospheric pressure as shown in FIG. 12. Then, the assembly is taken out from the oxidization chamber 47.

According to an experiment conducted by the inventors, it was found that when the brazing is performed in a high temperature environment the electric resistance of the PTC thermistor heating device would not substantially rise at the Curie point when it is heated by the application of an AC voltage across the terminal pieces 27 of the PTC thermistor heating device, and the PTC thermistor heating device lacks desired properties.

Figure 13:
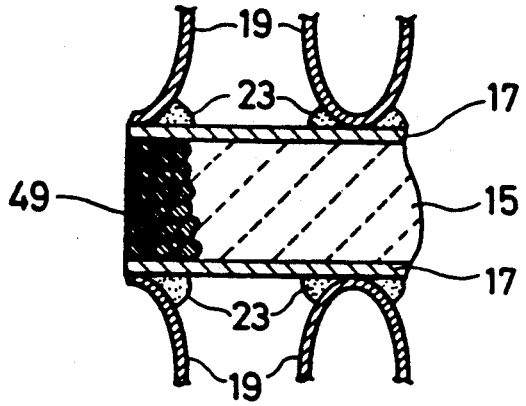
FIG. 13 is an enlarged fragmentary sectional view of the eleventh embodiment of the present invention.

The exact reason for this fact is not known to the inventors, but it is presumed that metallic substances such as magnesium which are added to the brazing material for improving its property may have separated from the brazing material and migrated into voids in the PTC thermistor element through its end surfaces thereby reducing its electrically insulating property or chemically reduced part of the PTC thermistor element 15. In FIG. 13, numeral 49 denotes the metallic component which has migrated into the PTC thermistor element 15 from its end surfaces. However, when the brazed PTC thermistor element is placed in a high-temperature atmospheric environment, the metallic component which has migrated into the PTC thermistor element 15 is oxidized into electrically insulating oxides, and the partly reduced PTC thermistor element is oxidized again, in either case, thereby restoring the favorable PTC property of the PTC thermistor element 15.

Figure 14:
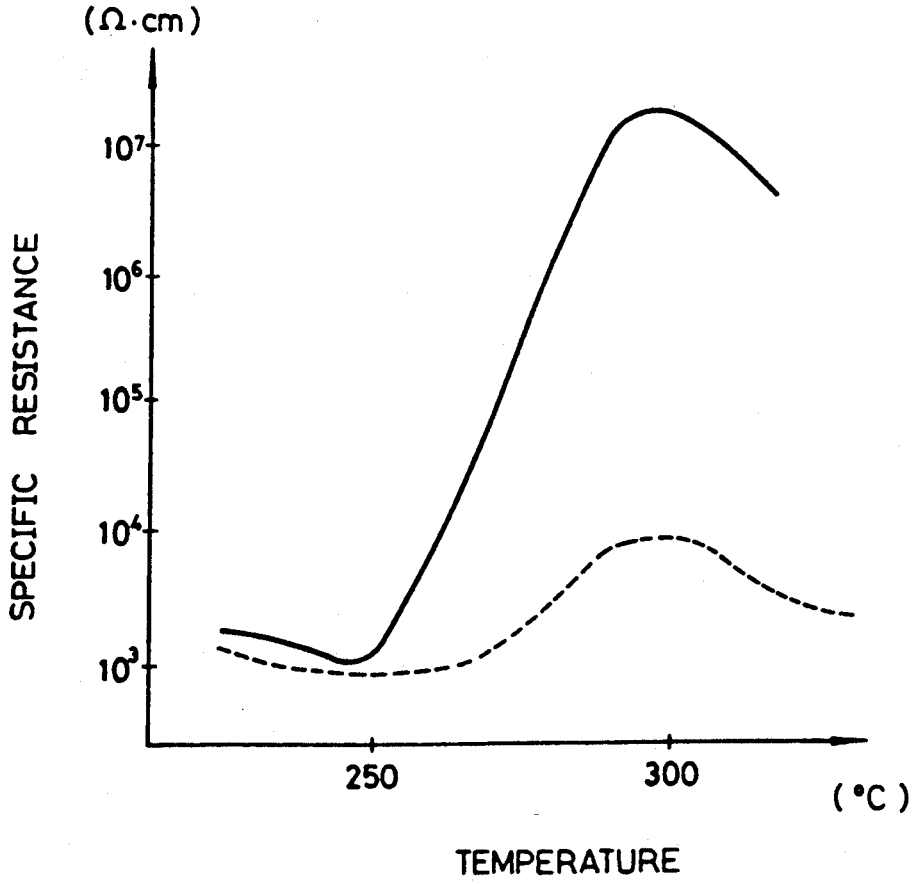
FIG. 14 is a graph showing the relationship between the temperature and the specific resistance of the eleventh embodiment of the present invention.

FIG. 14 is a so-called PTC property graph showing the changes in the specific resistance in relation with the temperature of the PTC thermistor element for the case when the PTC thermistor element is fabricated without heating it after brazing (broken line) and for the case when the PTC thermistor heating device is fabricated by heating it after brazing (solid line). According to this graph, it can be seen that the PTC thermistor heating device fabricated according to the method of the present invention demonstrates a favorable PTC property.

It was also found by the inventors that the extent of the recovery of PTC thermistor device and the time required for its recovery depend on the temperature and pressure of the environment and the amount of existing oxygen in which the assembly is placed after brazing.

Figure 15:
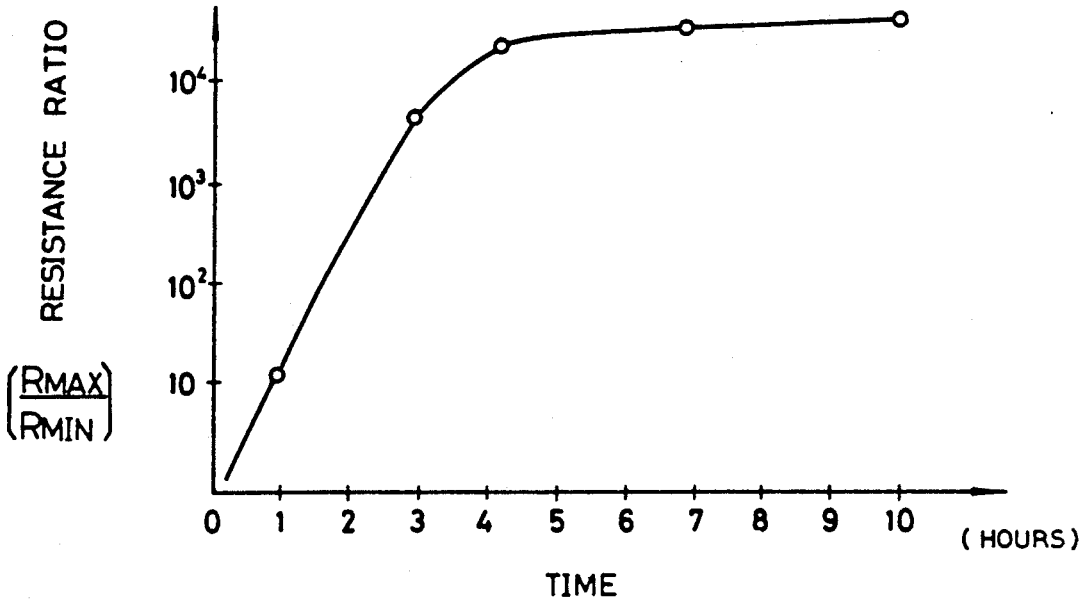
FIG. 15 is a graph showing the relationship between the time interval of a high-temperature oxidization process and the resulting resistance ration of the eleventh embodiment.

For instance, when a corrugated aluminum fin plate 19 is brazed to an aluminum electrode 17, and the PTC thermistor element 15 is left in an atmospheric environment at the temperature of 580 degrees C., it recovered to a practically acceptable extent in about four hours as shown in FIG. 15.

FIG. 15 shows the changes in the resistance ratio with time, and the resistance ratio is given by the maximum resistance/minimum resistance during the operation of the PTC thermistor element 15.

Figure 16:
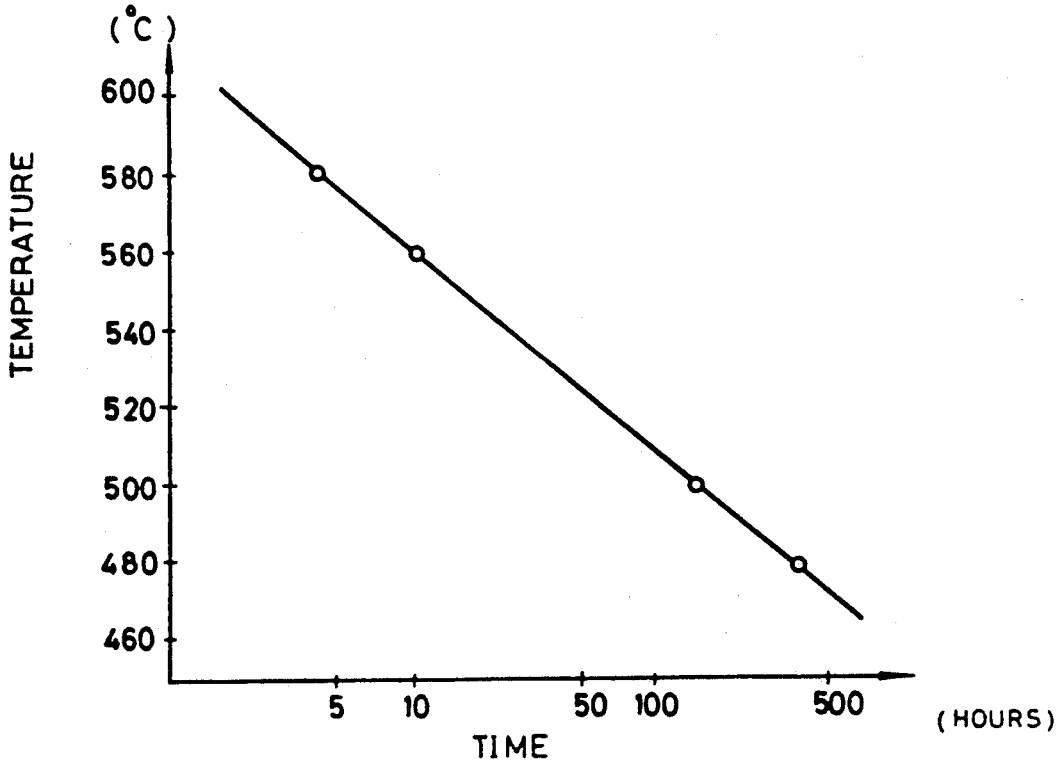
FIG. 16 is a graph showing the relationship between the recovery time required for recovery at various temperature levels.
Figure 17:
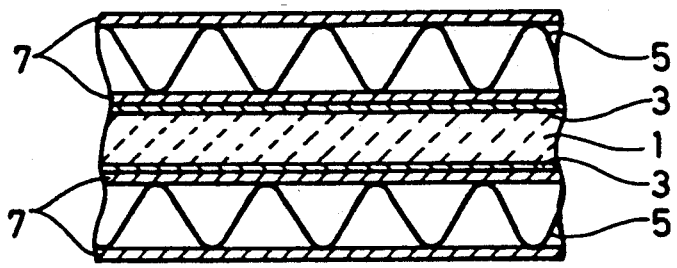
FIG. 17 (PRIOR ART)
FIGS. 17 and 18 are fragmentary sectional views of conventional PTC thermistor heating devices.
Figure 18:
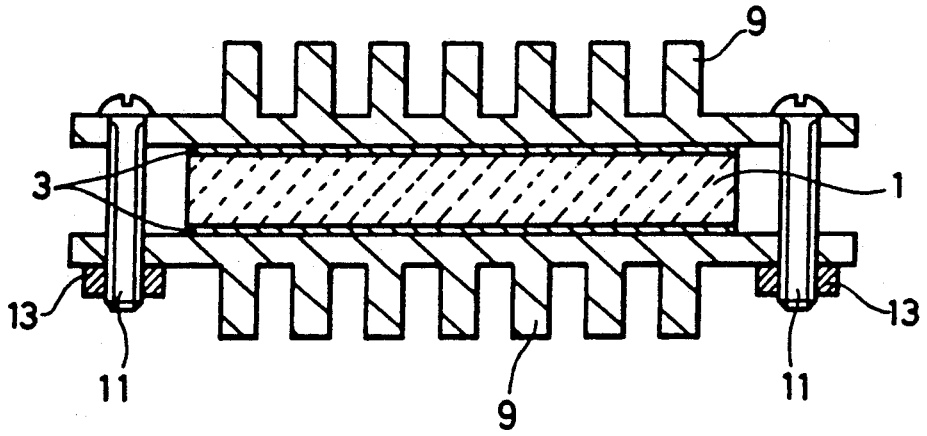
FIG. 18 (PRIOR ART)

On the other hand, as shown in FIG. 16, it took approximately 10 hours to recover substantially to the original property in the environment of 560 degrees C., and approximately 140 hours in the environment of 500 degrees C., and approximately 400 hours in the environment of 480 degrees C. Thus, the higher the temperature of the environment is, the less it takes to recover to the original property. It is possible to achieve a recovery even at a temperature lower than 480 degrees C., but it takes such a long time to recover that it is desirable to use a temperature higher than 480 degrees C. for practical purpose. However, if the temperature of the environment is increased excessively to further reduce the recovery time, the brazing material may melt and the attachment between the opposing electrodes 17 and the corrugated fin plates 19 may break. Therefore, in such a case, it may become necessary to take measures such as clamping the corrugated fin plates.

Some of the brazing materials may be used for brazing at temperatures lower than 480 degrees C., for instance at 350 degrees C., and, therefore, it may be desired to achieve the recovery of the original property using an environment temperature lower than 480 degrees C. But, for production efficiency, even in such a case, it would be preferred to use an environment temperature higher than 480 degrees C. and only slightly higher than the melting point of the brazing material.

Also, the recovery time may be reduced not only by increasing the temperature but also by increasing the pressure and/or the oxygen content of the environment. Therefore, it is preferred to place the PTC thermistor element 15 in a pressurized and oxidizing environment at a temperature exceeding 480 degrees C. to regain its property.

The above described eleventh embodiment is only an example of the present invention, and the present invention can be applied to PTC thermistor elements of various configurations and heat radiation fin plates of various kinds. Further, the vacuum chamber 45 and the oxidizing chamber 47 may consist of a common chamber.

It is possible to carry out the brazing process using a carrier gas such as nitrogen in a vacuum environment of approximately $10^{-5}$ Torr. In short, the object of the present invention can be accomplished by performing the brazing process in a non-oxidizing environment, preferably having a dew point lower than −50 degrees C.

Likewise, the object of the present invention can be achieved, when overlaying shield plates 39 and corrugated fin plates 19 onto metallic films 37 formed on a PTC thermistor element 15, and brazing these parts together, by performing the brazing process in a non-oxidizing environment and then exposing it to an oxidizing environment.

What we claim is:

1. A process for fabricating a PTC thermistor device, comprising the steps of:

forming a pair of opposing electrodes on either major surface of a PTC thermistor element consisting of a ceramic plate;

securing heat radiation fins formed of metallic plates to said opposing electrodes in a non-oxidizing environment by brazing; and exposing said PTC thermistor element to an oxidizing environment of a temperature higher than 480 degrees C. after securing said heat radiation fins thereto.

2. A process according to claim 1, wherein said heat radiation fins are formed by bending metallic heat radiation fin plates so as to define a plurality of peaks, and said securing step consists of brazing said peaks of said heat radiation fin plates to said opposing electrodes.

3. A process according to claim 2, wherein said opposing electrodes have a thickness of 50 to 300 micrometers.

4. A process for fabricating a PTC thermistor device, comprising the steps of:

forming metallic films on either major surface of a PTC thermistor element essentially consisting of a ceramic plate;

overlaying electroconductive shield layers on said metallic films to prevent emission of gas from said PTC thermistor element and metallic fin plates having a plurality of metallic fins defined therein on said shield layers, with peaks of said fins abutting said shield layers;

integrally joining the assembly consisting of said PTC thermistor element, said metallic films, said shield layers and said metallic fin plates by brazing them in a non-oxidizing environment; and placing said assembly in an oxidizing environment at a temperature higher than 480 degrees C.

5. A process according to claim 4, wherein said metallic film and said shield layer have a combined thickness of 50 to 300 micrometers.

* * * * *